US006231932B1

(12) United States Patent
Emch

(10) Patent No.: US 6,231,932 B1
(45) **Date of Patent: *May 15, 2001**

(54) PROCESSES FOR DRYING TOPCOATS AND MULTICOMPONENT COMPOSITE COATINGS ON METAL AND POLYMERIC SUBSTRATES

(75) Inventor: Donaldson J. Emch, Brighton, MI (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/320,522

(22) Filed: May 26, 1999

(51) Int. Cl.[7] ..... B05D 3/06

(52) U.S. Cl. ..... 427/542; 427/493; 427/379; 427/378

(58) Field of Search ..... 427/542, 384, 427/388.1, 386, 379, 410, 493, 377, 378

(56) References Cited

U.S. PATENT DOCUMENTS

| | | | |
|---|---|---|---|
| Re. 34,730 | 9/1994 | Salatin et al. | 427/407.1 |
| 1,998,615 | 4/1935 | Groven | 91/70 |
| 2,377,946 | 6/1945 | Leary | 18/19 |
| 2,387,516 | 10/1945 | Kaminski | 219/34 |
| 2,472,293 | 6/1949 | Groven | 34/60 |
| 2,478,001 | 8/1949 | Miskella | 219/35 |
| 2,498,339 | 2/1950 | Miskella | 91/55 |
| 2,876,135 | 3/1959 | Levine | 117/76 |
| 3,151,950 | 10/1964 | Newman et al. | 34/4 |
| 3,455,806 | 7/1969 | Spoor et al. | 204/181 |

(List continued on next page.)

FOREIGN PATENT DOCUMENTS

| | | |
|---|---|---|
| 196 42 970 | 4/1997 | (DE) . |
| 0038127 | 3/1981 | (EP) . |
| 0148718 | 11/1984 | (EP) . |
| 2091859 | 8/1982 | (GB) . |
| WO 98/40170 | 9/1998 | (WO) . |

OTHER PUBLICATIONS

"Infrared Flash Oven" Brochure, BGK Automotive Group 1989 (No month).

"Heated Flash Technical Specifications", General Motors NAO Paint General Technical Specifications Document No. 34909 (Jan. 14, 1997).

"Specifications for Heated Flash Off for Water–Borne Basecoat Application", Ford Motor Co. Body and Assembly Operations Sec. 240 (Jan. 15, 1995).

"The Proof Is In The Heating", Industrial Energy Efficiency Centre, U.K., HQ4ID (Apr. 25, 1995).

R. Hampshire "The Use of Radiant Heat Transfer in the Curing of Coatings on Complex Geometrics and Problematic Substrates", Interfinish 1996 World Congress, Birmingham, UK (Sep. 1996).

(List continued on next page.)

*Primary Examiner*—Marianne Padgett
(74) *Attorney, Agent, or Firm*—Ann Marie Cannoni; William J. Uhl

(57) ABSTRACT

The present invention provides processes for drying and/or curing topcoatings and multicomponent composite coatings applied to surfaces of metal or polymeric substrates which include applying infrared radiation and warm, low velocity air simultaneously to the coating for a period of at least about 30 seconds and increasing the substrate temperature at a predetermined rate to achieve a specified peak temperature. Infrared radiation and hot air are applied simultaneously to the coating for a period of at least about 3 minutes and the substrate temperature is increased at a predetermined rate to achieve a specified peak temperature, such that a dried and/or cured coating is formed upon the surface of the substrate.

30 Claims, 3 Drawing Sheets

U.S. PATENT DOCUMENTS

| | | | | |
|---|---|---|---|---|
| 3,591,767 | | 7/1971 | Mudie | 219/354 |
| 3,731,051 | | 5/1973 | Ellersick | 219/162 |
| 3,749,657 | | 7/1973 | Le Bras et al. | 204/181 |
| 3,953,643 | | 4/1976 | Cheung et al. | 428/220 |
| 3,953,644 | | 4/1976 | Camelon et al. | 428/220 |
| 3,998,716 | | 12/1976 | Masar et al. | 204/181 |
| 4,259,566 | | 3/1981 | Kobayashi | 219/222 |
| 4,265,936 | | 5/1981 | Prohaska, Jr. | 427/140 |
| 4,336,279 | | 6/1982 | Metzger | 427/55 |
| 4,349,724 | | 9/1982 | Ellersick | 219/347 |
| 4,389,970 | | 6/1983 | Edgerton | 118/666 |
| 4,390,564 | | 6/1983 | Kimble | 427/35 |
| 4,403,003 | | 9/1983 | Backhouse | 427/407.1 |
| 4,416,068 | | 11/1983 | Nilsson et al. | 34/4 |
| 4,423,312 | | 12/1983 | Wiedenfeld et al. | 219/388 |
| 4,461,094 | | 7/1984 | Schnalke | 34/9 |
| 4,535,548 | | 8/1985 | Hyde | 34/4 |
| 4,546,553 | | 10/1985 | Best | 34/39 |
| 4,594,266 | | 6/1986 | Lemaire et al. | 427/55 |
| 4,731,290 | | 3/1988 | Chang | 428/335 |
| 4,771,728 | | 9/1988 | Bergman, Jr. | 118/642 |
| 4,820,555 | | 4/1989 | Kuwajima et al. | 427/407.1 |
| 4,822,685 | | 4/1989 | Perez et al. | 428/423.3 |
| 4,891,111 | | 1/1990 | McCollum et al. | 204/181.7 |
| 4,894,261 | | 1/1990 | Gulbins et al. | 427/379 |
| 4,907,533 | | 3/1990 | Nelson et al. | 118/663 |
| 4,908,231 | | 3/1990 | Nelson et al. | 427/55 |
| 4,933,056 | | 6/1990 | Corrigan et al. | 204/181.7 |
| 4,943,447 | | 7/1990 | Nelson et al. | 427/55 |
| 4,971,837 | | 11/1990 | Martz et al. | 422/388.2 |
| 4,988,537 | * | 1/1991 | Tanimoto et al. | 427/542 |
| 5,050,232 | | 9/1991 | Bergman et al. | 392/412 |
| 5,075,132 | | 12/1991 | Ogasawara | 427/55 |
| 5,137,972 | | 8/1992 | Cook | 525/123 |
| 5,196,485 | | 3/1993 | McMonigal et al. | 525/327.3 |
| 5,323,485 | | 6/1994 | Josefsson et al. | 392/417 |
| 5,335,308 | | 8/1994 | Sorensen | 392/412 |
| 5,338,578 | | 8/1994 | Leach | 427/470 |
| 5,340,089 | | 8/1994 | Heath et al. | 266/87 |
| 5,401,790 | | 3/1995 | Poole et al. | 524/199 |
| 5,407,747 | | 4/1995 | Sammel et al. | 428/418 |
| 5,425,970 | | 6/1995 | Lahrmann et al. | 427/493 |
| 5,427,822 | | 6/1995 | Bracciano | 427/424 |
| 5,453,295 | | 9/1995 | Sammel et al. | 427/195 |
| 5,486,384 | | 1/1996 | Bastian et al. | 427/493 |
| 5,492,731 | | 2/1996 | Temple et al. | 427/407.1 |
| 5,551,670 | | 9/1996 | Heath et al. | 266/87 |
| 5,556,527 | | 9/1996 | Igarashi et al. | 204/488 |
| 5,612,095 | | 3/1997 | Brock et al. | 427/407.1 |
| 5,614,271 | | 3/1997 | Shibuya et al. | 427/541 |
| 5,635,302 | | 6/1997 | Budde et al. | 428/461 |
| 5,654,037 | | 8/1997 | Moore et al. | 427/379 |
| 5,698,310 | | 12/1997 | Nakamura et al. | 428/328 |
| 5,709,909 | | 1/1998 | Leibfarth et al. | 427/407.1 |
| 5,716,678 | | 2/1998 | Röckrath et al. | 427/407.1 |
| 5,760,107 | | 6/1998 | Valko et al. | 523/404 |
| 5,820,933 | | 10/1998 | Carroll | 427/314 |
| 5,820,987 | | 10/1998 | Kaufman et al. | 428/413 |
| 5,871,809 | | 2/1999 | Liedtke et al. | 427/140 |
| 5,888,592 | * | 3/1999 | Biallas et al. | 427/542 |
| B1 4,546,553 | | 4/1993 | Best | 34/39 |

OTHER PUBLICATIONS

W. Veenstra et al., "IRK Halogen Infrared Rediators in the Industrial Heating Process", Philips Lighting, Eindhoven, Netherlands, No date.

"Powder Coatings", Blasdel Equipment Infrared Ovens http://blasdelent,com/powder.html (Mar. 12, 1999).

"Gas Infrared Ovens", Thermovation Engineering Inc. http://www.thomasregister.com/olc/thermovation/gas.htm (Mar. 12, 1999).

* cited by examiner

PROCESSES FOR DRYING TOPCOATS AND MULTICOMPONENT COMPOSITE COATINGS ON METAL AND POLYMERIC SUBSTRATES

CROSS-REFERENCE TO RELATED APPLICATIONS

This patent application is related to U.S. patent application Ser. No. 09/320,265 entitled "Multi-Stage Processes for Coating Substrates with Liquid Basecoat and Liquid Topcoat"; U.S. patent application Ser. No. 09/320,264 entitled "Multi-Stage Processes for Coating Substrates with Liquid Basecoat and Powder Topcoat"; U.S. patent application Ser. No. 09/320,483 entitled "Processes for Coating a Metal Substrate with an Electrodeposited Coating Composition and Drying the Same"; and U.S. patent application Ser. No. 09/320,484 entitled "Processes For Drying and Curing Primer Coating Compositions", all of Donaldson J. Emch and each filed concurrently with the present application.

FIELD OF THE INVENTION

The present invention relates to drying and/or curing coatings for automotive applications and, more particularly, to multi-stage processes for drying and/or curing topcoats and multicomponent composite coatings by a combination of infrared radiation and convection drying.

BACKGROUND OF THE INVENTION

Today's automobile bodies are treated with multiple layers of coatings which not only enhance the appearance of the automobile, but also provide protection from corrosion, chipping, ultraviolet light, acid rain and other environmental conditions which can deteriorate the coating appearance and underlying car body.

The formulations of these coatings can vary widely. However, a major challenge that faces all automotive manufacturers is how to rapidly dry and cure these coatings with minimal capital investment and floor space, which is valued at a premium in manufacturing plants.

Various ideas have been proposed to speed up drying and curing processes for automobile coatings, such as hot air convection drying. While hot air drying is rapid, a skin can form on the surface of the coating which impedes the escape of volatiles from the coating composition and causes pops, bubbles or blisters which ruin the appearance of the dried coating.

Other methods and apparatus for drying and curing a coating applied to an automobile body are disclosed in U.S. Pat. Nos. 4,771,728; 4,907,533; 4,908,231 and 4,943,447, in which the automobile body is heated with radiant heat for a time sufficient to set the coating on Class A surfaces of the body and subsequently cured with heated air.

U.S. Pat. No. 4,416,068 discloses a method and apparatus for accelerating the drying and curing of refinish coatings for automobiles using infrared radiation. Ventilation air used to protect the infrared radiators from solvent vapors is discharged as a laminar flow over the car body. FIG. 15 is a graph of temperature as a function of time showing the preferred high temperature/short drying time curve 122 versus conventional infrared drying (curve 113) and convection drying (curve 114). Such rapid, high temperature drying techniques can be undesirable because a skin can form on the surface of the coating that can cause pops, bubbles or blisters, as discussed above.

U.S. Pat. No. 4,336,279 discloses a process and apparatus for drying automobile coatings using direct radiant energy, a majority of which has a wavelength greater than 5 microns. Heated air is circulated under turbulent conditions against the back sides of the walls of the heating chamber to provide the radiant heat. Then, the heated air is circulated as a generally laminar flow along the inner sides of the walls to maintain the temperature of the walls and remove volatiles from the drying chamber. As discussed at column 7, lines 18–22, air movement is maintained at a minimum in the central portion of the inner chamber in which the automobile body is dried.

A rapid, multi-stage drying process for automobile coatings is needed which inhibits formation of surface defects and discoloration in the coating, particularly for use with topcoats and multicomponent composite coatings.

SUMMARY OF THE INVENTION

The present invention provides a process for drying a liquid topcoating composition applied to a surface of a metal substrate, comprising the steps of: (a) exposing the liquid topcoating composition to air having a temperature ranging from about 10° C. to about 40° C. for a period of at least about 30 seconds to volatilize at least a portion of volatile material from the liquid topcoating composition, the velocity of the air at a surface of the topcoating composition being less than about 0.5 meters per second; (b) applying infrared radiation and warm air simultaneously to the topcoating composition for a period of at least about 1 minute, the velocity of the air at the surface of the topcoating composition being less than about 4 meters per second, the temperature of the metal substrate being increased at a rate ranging from about 0.1° C. per second to about 0.25° C. per second to achieve a peak metal temperature of the substrate ranging from about 25° C. to about 50° C.; and (c) applying infrared radiation and hot air simultaneously to the topcoating composition for a period of at least about 30 seconds, the temperature of the metal substrate being increased at a rate ranging from about 0.5° C. per second to about 1.6° C. per second to achieve a peak metal temperature of the substrate ranging from about 65° C. to about 140° C., such that a dried topcoat is formed upon the surface of the metal substrate.

Another aspect of the present invention is a process for drying a multicomponent composite coating composition applied to a surface of a metal substrate, comprising the steps of: (a) applying a liquid basecoating composition to the surface of the metal substrate; (b) applying a liquid topcoating composition over the basecoating composition to form a multicomponent composite coating upon the metal substrate; (c) exposing the multicomponent composite coating to air having a temperature ranging from about 10° C. to about 40° C. for a period of at least about 30 seconds to volatilize at least a portion of volatile material from the multicomponent composite coating, the velocity of the air at a surface of the multicomponent composite coating composition being less than about 1 meter per second; (d) applying infrared radiation and warm air simultaneously to the multicomponent composite coating for a period of at least about 1 minute, the velocity of the air at the surface of the multicomponent composite coating being less than about 4 meters per second, the temperature of the metal substrate being increased at a rate ranging from about 0.1° C. per second to about 0.25° C. per second to achieve a peak metal temperature of the substrate ranging from about 25° C. to about 50° C.; and (e) applying infrared radiation and hot air simultaneously to the multicomponent composite coating for a period of at least about 30 seconds, the temperature of the metal substrate being increased at a rate ranging from about 0.5° C. per second to about 1.6° C. per second to achieve a peak metal temperature of the substrate ranging from about 65° C. to about 140° C., such that a dried multicomponent composite coating is formed upon the surface of the metal substrate.

Yet another aspect of the present invention is a process for coalescing a powder topcoating composition applied to a surface of a metal substrate, comprising the steps of: (a) applying infrared radiation and warm air simultaneously to the powder topcoating composition for a period of at least about 2.5 minutes, the velocity of the air at the surface of the powder topcoating composition being less than about 4 meters per second, the temperature of the metal substrate being increased at a rate ranging from about 0.5° C. per second to about 0.8° C. per second to achieve a peak metal temperature of the substrate ranging from about 90° C. to about 125° C.; and (b) applying infrared radiation and hot air simultaneously to the powder topcoating composition for a period of at least about 2 minutes, the temperature of the metal substrate being increased at a rate ranging from about 0.1° C. per second to about 1.5° C. per second to achieve a peak metal temperature of the substrate ranging from about 125° C. to about 200° C., such that a coalesced topcoat is formed upon the surface of the metal substrate.

Another aspect of the present invention is a process for drying a multicomponent composite coating composition applied to a surface of a metal substrate, comprising the steps of: (a) applying a liquid basecoating composition to the surface of the metal substrate; (b) applying a liquid topcoating composition over the basecoating composition to form a multicomponent composite coating upon the metal substrate; (c) exposing the multicomponent composite coating to air having a temperature ranging from about 10° C. to about 40° C. for a period of at least about 30 seconds to volatilize at least a portion of volatile material from both the basecoating composition and topcoating composition, the velocity of the air at a surface of the multicomponent composite coating composition being less than about 4 meters per second; (d) applying infrared radiation and warm air simultaneously to the multicomponent composite composition for a period of at least about 1 minute, the velocity of the air at the surface of the multicomponent composite composition being less than about 4 meters per second, the temperature of the metal substrate being increased at a rate ranging from about 0.1 ° C. per second to about 0.25° C. per second to achieve a peak metal temperature of the substrate ranging from about 25° C. to about 50° C.; and (e) applying infrared radiation and hot air simultaneously to the multicomponent composite composition for a period of at least about 30 seconds, the temperature of the metal substrate being increased at a rate ranging from about 0.5° C. per second to about 1.0° C. per second to achieve a peak metal temperature of the substrate ranging from about 130° C. to about 150° C., such that a dried multicomponent composite coating is formed upon the surface of the metal substrate.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE PREFERRED EMBODIMENTS

Figure 1:
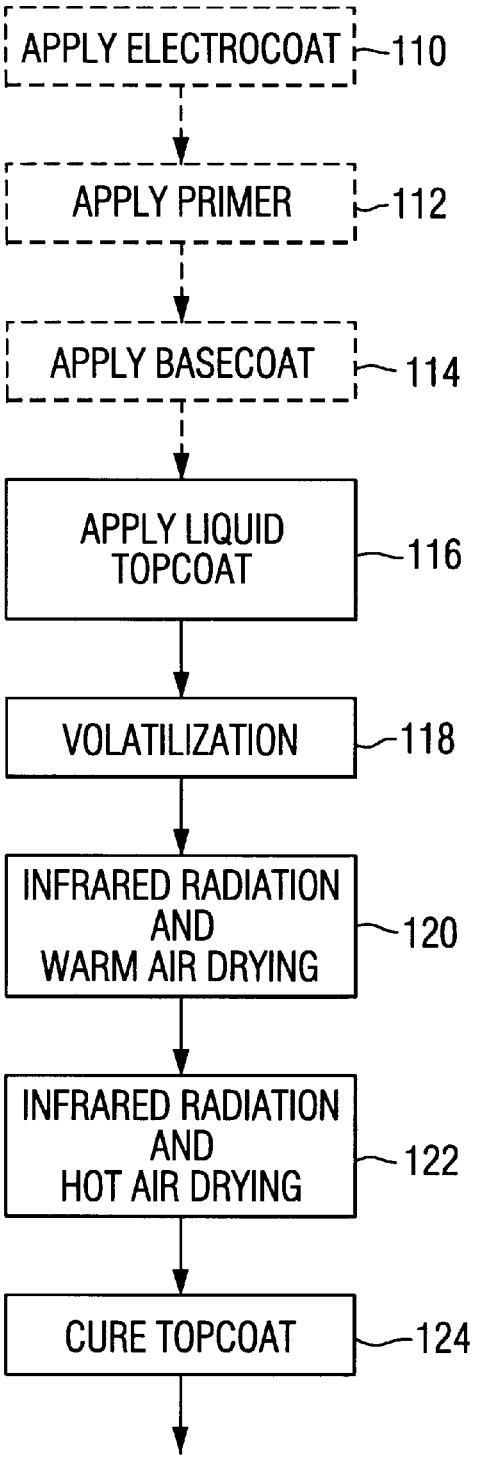
FIG. 1 is a flow diagram of a process for drying a liquid topcoat or multicomponent composite coating according to the present invention.
Figure 1A:
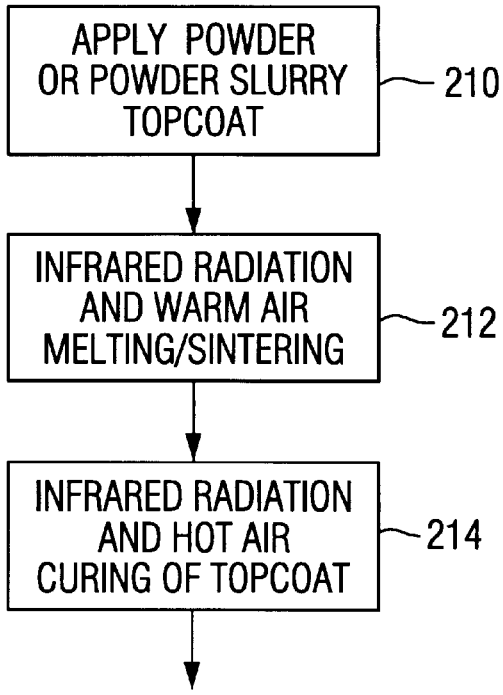
FIG. 1A is a flow diagram of a process for drying a powder or powder slurry topcoat or multicomponent composite coating according to the present invention.

Referring to the drawings, in which like numerals indicate like elements throughout, FIGS. 1 and 1A show flow diagrams of multi-stage processes for drying coatings according to the present invention.

These processes are suitable for coating metal or polymeric substrates in a batch or continuous manner. In a batch process, the substrate is stationary during each treatment step of the process, whereas in a continuous process the substrate is in continuous movement along an assembly line. The present invention will now be discussed generally in the context of coating a substrate in a continuous assembly line process, although the process also is useful for coating substrates in a batch process.

Useful substrates that can be coated according to the process of the present invention include metal substrates, polymeric substrates, such as thermoset materials and thermoplastic materials, and combinations thereof. Useful metal substrates that can be coated according to the process of the present invention include ferrous metals such as iron, steel, and alloys thereof, non-ferrous metals such as aluminum, zinc, magnesium and alloys thereof, and combinations thereof. Preferably, the substrate is formed from cold rolled steel, electrogalvanized steel such as hot dip electrogalvanized steel or electrogalvanized iron-zinc steel, aluminum or magnesium.

Useful thermoset materials include polyesters, epoxides, phenolics, polyurethanes such as reaction injected molding urethane (RIM) thermoset materials and mixtures thereof. Useful thermoplastic materials include thermoplastic polyolefins such as polyethylene and polypropylene, polyamides such as nylon, thermoplastic polyurethanes, thermoplastic polyesters, acrylic polymers, vinyl polymers, polycarbonates, acrylonitrile-butadiene-styrene (ABS) copolymers, EPDM ethylene propylene diene monomer L rubber, copolymers and mixtures thereof.

Preferably, the substrates are used as components to fabricate automotive vehicles, including but not limited to automobiles, trucks and tractors. The substrates can have any shape, but are preferably in the form of automotive body components such as bodies (frames), hoods, doors, fenders, bumpers and/or trim for automotive vehicles.

The present invention first will be discussed generally in the context of coating a metallic automobile body. One skilled in the art would understand that the process of the present invention also is useful for coating non-automotive metal and/or polymeric components, which will be discussed below.

Prior to treatment according to the process of the present invention, the metal substrate can be cleaned and degreased and a pretreatment coating, such as CHEMFOS 700 zinc phosphate or BONAZINC zinc-rich pretreatment (each commercially available from PPG Industries, Inc. of Pittsburgh, Pa.), can be deposited upon the surface of the metal substrate.

Before applying the primer coating to the substrate, a liquid electrodepositable coating composition can be applied to a surface of the metal substrate (automobile body 16 shown in FIG. 2) in a first step 110 (shown in FIG. 1). The liquid electrodepositable coating composition can be applied to the surface of the substrate in step 110 by any suitable anionic or cationic electrodeposition process well known to those skilled in the art. In a cationic electrodeposition process, the liquid electrodepositable coating composition is placed in contact with an electrically conductive anode and an electrically conductive cathode with the metal surface to be coated being the cathode. Following contact with the liquid electrodepositable coating composition, an adherent film of the coating composition is deposited on the cathode when sufficient voltage is impressed between the electrodes. The conditions under which electrodeposition is carried out are, in general, similar o those used in electrodeposition of other coatings. The applied voltages an be varied and can be, for example, as low as 1 volt to as high as several thousand volts, but typically between 50 and 500 volts. The current density is usually between 0.5 and 15 amperes per square foot and tends to decrease during electrodeposition indicating the formation of an insulating film.

Useful electrodepositable coating compositions include anionic or cationic electrodepositable compositions well known to those skilled in the art. Such compositions generally comprise one or more film-forming materials and crosslinking materials. Suitable film-forming materials include epoxy-functional film-forming materials, polyurethane film-forming materials, and acrylic film-forming materials. The amount of film-forming material in the electrodepositable composition generally ranges from about 50 to about 95 weight percent on a basis of total weight solids of the electrodepositable composition.

Suitable epoxy-functional materials contain at least one, and preferably two or more, epoxy or oxirane groups in the molecule, such as di- or polyglycidyl ethers of polyhydric alcohols. Useful polyglycidyl ethers of polyhydric alcohols can be formed by reacting epihalohydrins, such as epichlorohydrin, with polyhydric alcohols, such as dihydric alcohols, in the presence of an alkali condensation and dehydrohalogenation catalyst such as sodium hydroxide or potassium hydroxide. Suitable polyhydric alcohols can be aromatic, such as bisphenol A, aliphatic, such as glycols or polyols, or cycloaliphatic. Suitable epoxy-functional materials have an epoxy equivalent weight ranging from about 100 to about 2000, as measured by titration with perchloric acid using methyl violet as an indicator. Useful polyepoxides are disclosed in U.S. Pat. No. 5,820,987 at column 4, line 52 through column 6, line 59, which is incorporated by reference herein. The epoxy-functional material can be reacted with an amine to form cationic salt groups, for example with primary or secondary amines which can be acidified after reaction with the epoxy groups to form amine salt groups or tertiary amines which can be acidified prior to reaction with the epoxy groups and which after reaction with the epoxy groups form quaternary ammonium salt groups. Other useful cationic salt group formers include sulfides.

Suitable acrylic-functional film-forming materials include polymers derived from alkyl esters of acrylic acid and methacrylic acid such as are disclosed in U.S. Pat. Nos. 3,455,806 and 3,928,157, which are incorporated herein by reference.

Examples of film-forming resins suitable for anionic electrodeposition include base-solubilized, carboxylic acid containing polymers such as the reaction product or adduct of a drying oil or semi-drying fatty acid ester with a dicarboxylic acid or anhydride; and the reaction product of a fatty acid ester, unsaturated acid or anhydride and any additional unsaturated modifying materials which are further reacted with polyol. Also suitable are at least partially neutralized interpolymers of hydroxy-alkyl esters of unsaturated carboxylic acids, unsaturated carboxylic acid and at least one other ethylenically unsaturated monomer. Other suitable electrodepositable resins comprise an alkyd-aminoplast vehicle, i.e., a vehicle containing an alkyd resin and an amine-aldehyde resin or mixed esters of a resinous polyol. These compositions are described in detail in U.S. Pat. No. 3,749,657 at column 9, lines 1 to 75 and column 10, lines 1 to 13, which is incorporated by reference herein. Other acid functional polymers can also be used such as phosphatized polyepoxide or phosphatized acrylic polymers which are well known to those skilled in the art.

Useful crosslinking materials for the electrodepositable coating composition comprise blocked or unblocked polyisocyanates including as aromatic diisocyanates; aliphatic diisocyanates such as 1,6-hexamethylene diisocyanate; and cycloaliphatic diisocyanates such as isophorone diisocyanate and 4,4'-methylene-bis(cyclohexyl isocyanate). Examples of suitable blocking agents for the polyisocyanates include lower aliphatic alcohols such as methanol, oximes such as methyl ethyl ketoxime and lactams such as caprolactam. The amount of the crosslinking material in the electrodepositable coating composition generally ranges from about 5 to about 50 weight percent on a basis of total resin solids weight of the electrodepositable coating composition.

Generally, the electrodepositable coating composition also comprises one or more pigments which can be incorporated in the form of a paste, surfactants, wetting agents, catalysts, film build additives, flatting agents, defoamers, microgels, pH control additives and volatile materials such as water and organic solvents, as described in U.S. Pat. No. 5,820,987 at column 9, line 13 through column 10, line 27. Useful solvents included in the composition, in addition to any provided by other coating components, include coalescing solvents such as hydrocarbons, alcohols, esters, ethers and ketones. Preferred coalescing solvents include alcohols, polyols, ethers and ketones. The amount of coalescing solvent is generally about 0.05 to about 5 weight percent on a basis of total weight of the electrodepositable coating composition.

Other useful electrodepositable coating compositions are disclosed in U.S. Pat. Nos. 4,891,111; 5,760,107; and 4,933,056, which are incorporated herein by reference. The solids content of the liquid electrodepositable coating composition generally ranges from about 3 to about 75 weight percent, and preferably about 5 to about 50 weight percent.

If the electrodepositable coating composition is applied by immersing the metal substrate into a bath, after removing the substrate from the bath the substrate is exposed to air to permit excess electrodeposited coating composition to drain from the interior cavities and surfaces of the substrate. Preferably, the drainage period is at least 5 minutes, and more preferably bout 5 to about 10 minutes so that there is no standing water from the final water rinse. The temperature of the air during the drainage period preferably ranges from about 10° C. to about 40° C. The velocity of the air during drainage is preferably less than about 0.5 meters per second.

The thickness of the electrodepositable coating applied to the substrate can vary based upon such factors as the type of substrate and intended use of the substrate, i.e., the environment in which the substrate is to be placed and the nature of the contacting materials. Generally, the thickness of the electrodepositable coating applied to the substrate ranges from about 5 to about 40 micrometers, and more preferably about 12 to about 35 micrometers.

The electrodeposited coating can be dried and cured, if desired, prior to the next step 112 of applying the primer. The electrodeposited coating can be dried, for example, by hot air convection drying or infrared drying. Preferably, the electrodeposited coating is dried by first exposing the electrodeposited coating composition to low velocity air (less than about 0.5 meters per second) having a temperature ranging from about 10° C. to about 40° C. for a period of at least about 30 seconds to volatilize at least a portion of the volatile material from the liquid electrodeposited coating composition and set the electrodeposited coating. Next, infrared radiation and low velocity warm air can be applied simultaneously to the electrodeposited coating for a period of at least about 1 minute such that the temperature of the metal substrate is increased at a rate ranging from about 0.25° C. per second to about 2° C. per second to achieve a peak metal temperature ranging from about 35° C. to about 140° C. and form a pre-dried electrodeposited coating upon the surface of the metal substrate. To form a dried electrocoat, infrared radiation and hot air can be applied simultaneously to the electrodeposited coating on the metal substrate for a period of at least about 2 minutes during which the temperature of the metal substrate is increased at a rate ranging from about 0.2° C. per second to about 1.5° C. per second to achieve a peak metal temperature of the substrate ranging from about 160° C. to about 215° C. and subsequently cured by maintaining the peak metal temperature for at least about 6 minutes. Suitable apparatus for drying and curing the basecoat using a combination of infrared and convection heat are discussed in detail below for drying the topcoating.

Referring now to FIG. 1, a primer (primer/surfacer) coating composition is applied over at least a portion of the electrodeposited coating. The primer coating composition can be liquid, powder slurry or powder (solid), as desired. The liquid or powder slurry primer coating can be applied to the surface of the substrate by any suitable coating process well known to those skilled in the art, for example by dip coating, direct roll coating, reverse roll coating, curtain coating, spray coating, brush coating and combinations thereof. Powder coatings are generally applied by electrostatic deposition. The method and apparatus for applying the primer composition to the substrate is determined in part by the configuration and type of substrate material.

The liquid or powder slurry primer coating composition generally comprises one or more film-forming materials, volatile materials and, optionally, pigments. Volatile materials are not present in the powder coating composition. Preferably, the primer coating composition, whether liquid, powder slurry or powder, comprises one or more thermosetting film-forming materials, such as polyurethanes, acrylics, polyesters, epoxies and crosslinking materials.

Suitable polyurethanes include the reaction products of polymeric polyols such as polyester polyols or acrylic polyols with a polyisocyanate, including aromatic diisocyanates such as 4,4'-diphenylmethane diisocyanate, aliphatic diisocyanates such as 1,6-hexamethylene diisocyanate, and cycloaliphatic diisocyanates such as isophorone diisocyanate and 4,4'-methylene-bis(cyclohexyl isocyanate). Suitable acrylic polymers include polymers of acrylic acid, methacrylic acid and alkyl esters thereof. Other useful film-forming materials and other components for primers are disclosed in U.S. Pat. Nos. 4,971,837; 5,492,731 and 5,262,464, which are incorporated herein by reference. The amount of film-forming material in the primer generally ranges from about 37 to about 60 weight percent on a basis of total resin solids weight of the primer coating composition.

Suitable crosslinking materials include aminoplasts, polyisocyanates (discussed above) and mixtures thereof. Useful aminoplast resins are based on the addition products of formaldehyde, with an amino- or amido-group carrying substance. Condensation products obtained from the reaction of alcohols and formaldehyde with melamine, urea or benzoguanamine are most common. The amount of the crosslinking material in the primer coating composition generally ranges from about 5 to about 50 weight percent on a basis of total resin solids weight of the primer coating composition.

Volatile materials which can be included in the liquid or powder slurry primer coating composition include water and/or organic solvents, such as alcohols; ethers and ether alcohols; ketones; esters; aliphatic and alicyclic hydrocarbons; and aromatic hydrocarbons. The amount of volatile material in the primer coating composition can range from about 1 to about 30 weight percent on a total weight basis of the primer coating composition.

Other additives, such as plasticizers, antioxidants, mildewcides, fungicides, surfactants, fillers and pigments, can be present in the primer coating composition in amounts generally up to about 40 weight percent. Useful fillers and pigments are disclosed in U.S. Pat. No. 4,971,837, which is incorporated herein by reference. For the liquid and powder slurry primer coating compositions, the weight percent solids of the coating generally ranges from about 30 to about 80 weight percent on a total weight basis.

Referring now to FIG. 1, if the primer coating composition applied to the surface of the substrate is in liquid form, the primer can be exposed to low velocity air (less than about 4 meters per second) having a temperature ranging from about 10° C. to about 50° C. for a period of at least about 30 seconds to volatilize at least a portion of the volatile material from the liquid primer coating composition and set the primer coating. As used herein, the term "set" means that the liquid primer coating is tack-free (resists adherence of dust and other airborne contaminants) and is not disturbed or marred (waved or rippled) by air currents which blow past the primer coated surface. This step is not necessary for treating powder or powder slurry primer coatings.

The volatilization or evaporation of volatiles from the surface of the liquid primer coating can be carried out in the open air, but is preferably carried out in a drying chamber such as is described below for the topcoat. Next, infrared radiation and low velocity warm air are applied simultaneously to the primer coating for a period of at least about 1 minute such that the temperature of the metal substrate is increased at a rate ranging from about 0.05° C. per second to about 2° C. per second to achieve a peak metal temperature ranging from about 35° C. to about 110° C. and form a pre-dried primer coating upon the surface of the metal substrate. As used herein, "peak metal temperature" means the minimum target temperature to which the metal substrate (automobile body 16) must be heated. The peak metal temperature for a metal substrate is measured at the surface of the coated substrate approximately in the middle of the side of the substrate opposite the side on which the coating is applied. The peak temperature for a polymeric substrate is measured at the surface of the coated substrate approximately in the middle of the side of the substrate on which the coating is applied. It is preferred that this peak metal temperature be maintained for as short a time as possible to minimize the possibility of crosslinking the coating.

Alternatively, for treating a powder slurry or powder primer coating, infrared radiation and low velocity warm air are applied to the coated metal substrate simultaneously for a period of at least about 2 minutes such that the temperature of the metal substrate is increased at a rate ranging from about 0.5° C. per second to about 1° C. per second to achieve a peak metal temperature ranging from about 90° C. to about 110° C. and form a pre-dried primer coating upon the surface of the metal substrate.

To more fully dry or coalesce the primer, infrared radiation and hot air can be applied simultaneously to the primer coating on the metal substrate (automobile body 16) for a period of at least about 2 minutes. The temperature of the metal substrate is increased at a rate ranging from about 0.1° C. per second to about 1° C. per second to achieve a peak metal temperature of the substrate ranging from about 40° C. to about 155° C. for a liquid primer, about 125° C. to about 140° C. for powder slurry primer and about 160° C. to about 200° C. for a powder primer.

These steps can be carried out in a similar manner to that of steps 120 and 122 below using a combination infrared radiation/convection drying apparatus, however the rate at which the temperature of the metal substrate is increased and peak metal temperature of the substrate vary as specified.

The primer coating that is formed upon the surface of the automobile body 16 is dried and coalesced sufficiently to enable application of a basecoat such that the quality of the basecoat will not be affected adversely by further drying or coalescence of the primer. Preferably, the primer is cured prior to application of the basecoat. To cure the primer, the process of the present invention can further comprise an additional curing step in which hot air 66 is applied to the primer (and any uncured electrocoat, if present) for a period of at least about 15 minutes to achieve a peak metal temperature ranging from about 160° C. to about 200° C. and cure the primer. Preferably, a combination of hot air convection drying and infrared radiation is used simultaneously to cure the primer and electrocoat, if present. As used herein, "cure" means that any crosslinkable components of the primer and electrocoat are substantially crosslinked. This curing step can be carried out using a hot air convection oven, such as an automotive radiant wall/convection oven which is commercially available from Durr, Haden or Thermal Engineering Corp. or in a similar manner to that of step 124 above using a combination infrared radiation/convection drying apparatus.

The process of the present invention can further comprise a cooling step in which the temperature of the automobile body having the dried and/or cured primer thereon is cooled, preferably to a temperature ranging from about 20° C. to about 60° C. Cooling the primer coated automobile body can facilitate application of the next coating of liquid basecoat thereon by preventing a rapid flash of the liquid basecoat volatiles which can cause poor flow, rough surfaces and generally poor appearance. The primer coated automobile body can be cooled in air at a temperature ranging from about 15° C. to about 35° C. or by exposure to chilled, saturated air blown onto the surface of the substrate at about 4 to about 10 meters per second to prevent cracking of the coating.

The process of the present invention can further comprise a step 114 of applying a liquid basecoating composition upon the surface of the dried and/or cured electrocoat or primer. The liquid basecoating can be applied to the surface of the substrate by any suitable coating process well known to those skilled in the art, for example by dip coating, direct roll coating, reverse roll coating, curtain coating, spray coating, brush coating and combinations thereof.

The liquid basecoating composition comprises a film-forming material or binder, volatile material and optionally pigment. Preferably, the basecoating composition is a crosslinkable coating composition comprising at least one thermosettable film-forming material, such as acrylics, polyesters (including alkyds), polyurethanes and epoxies, and at least one crosslinking material such as are discussed above. Thermoplastic film-forming materials such as polyolefins also can be used. The amount of film-forming material in the liquid basecoat generally ranges from about 40 to about 97 weight percent on a basis of total solids of the basecoating composition. The amount of crosslinking material in the basecoat coating composition generally ranges from about 5 to about 50 weight percent on a basis of total resin solids weight of the basecoat coating composition.

Suitable acrylic film-forming polymers include copolymers of one or more of acrylic acid, methacrylic acid and alkyl esters thereof, such as methyl methacrylate, ethyl methacrylate, hydroxyethyl methacrylate, butyl methacrylate, ethyl acrylate, hydroxyethyl acrylate, butyl acrylate and 2-ethylhexyl acrylate, optionally together with one or more other polymerizable ethylenically unsaturated monomers including vinyl aromatic compounds such as styrene and vinyl toluene, nitriles such as acrylontrile and methacrylonitrile, vinyl and vinylidene halides, and vinyl esters such as vinyl acetate. Other suitable acrylics and methods for preparing the same are disclosed in U.S. Pat. No. 5,196,485 at column 11, lines 16–60, which are incorporated herein by reference.

Polyesters and alkyds are other examples of resinous binders useful for preparing the basecoating composition. Such polymers can be prepared in a known manner by condensation of polyhydric alcohols, such as ethylene glycol, propylene glycol, butylene glycol, 1,6-hexylene glycol, neopentyl glycol, trimethylolpropane and pentaerythritol, with polycarboxylic acids such as adipic acid, maleic acid, fumaric acid, phthalic acids, trimellitic acid or drying oil fatty acids.

Polyurethanes also can be used as the resinous binder of the basecoat. Useful polyurethanes include the reaction products of polymeric polyols such as polyester polyols or acrylic polyols with a polyisocyanate, including aromatic diisocyanates such as 4,4'-diphenylmethane diisocyanate, aliphatic diisocyanates such as 1,6-hexamethylene diisocyanate, and cycloaliphatic diisocyanates such as isophorone diisocyanate and 4,4'-methylene-bis(cyclohexyl isocyanate).

The liquid basecoating composition comprises one or more volatile materials such as water, organic solvents and/or amines. The solids content of the liquid basecoating composition generally ranges from about 15 to about 60 weight percent, and preferably about 20 to about 50 weight percent.

The basecoating composition can further comprise one or more additives such as pigments, fillers, UV absorbers, rheology control agents or surfactants. Useful pigments and fillers include aluminum flake, bronze flakes, coated mica, nickel flakes, tin flakes, silver flakes, copper flakes, mica, iron oxides, lead oxides, carbon black, titanium dioxide and talc. The specific pigment to binder ratio can vary widely so long as it provides the requisite hiding at the desired film thickness and application solids.

Suitable waterborne basecoats for color-plus-clear composites include those disclosed in U.S. Pat. Nos. 4,403,003; 5,401,790 and 5,071,904, which are incorporated by reference herein. Also, waterborne polyurethanes such as those prepared in accordance with U.S. Pat. No. 4,147,679 can be used as the resinous film former in the basecoat, which is incorporated by reference herein. Suitable film formers for organic solvent-based base coats are disclosed in U.S. Pat. No. 4,220,679 at column 2, line 24 through column 4, line 40 and U.S. Pat. No. 5,196,485 at column 11, line 7 through column 13, line 22, which are incorporated by reference herein.

The thickness of the basecoating composition applied to the substrate can vary based upon such factors as the type of substrate and intended use of the substrate, i.e., the environment in which the substrate is to be placed and the nature of the contacting materials. Generally, the thickness of the basecoating composition applied to the substrate ranges from about 10 to about 38 micrometers, and more preferably about 12 to about 30 micrometers.

The basecoat can be dried by conventional hot air convection drying or infrared drying, but preferably is dried by exposing the basecoat to low velocity air to volatilize at least a portion of the volatile material from the liquid basecoating composition and set the basecoating composition. The basecoating composition can be exposed to air having a temperature ranging from about 10° C. to about 50° C. for a period of at least about 5 minutes to volatilize at least a portion of volatile material from the liquid basecoating composition, the velocity of the air at a surface of the basecoating composition being less than about 0.5 meters per second, using apparatus similar to step 118 below. Infrared radiation and hot air can be applied simultaneously to the basecoating composition for a period of at least about 2 minutes, to increase the temperature of the metal substrate at a rate ranging from about 0.4° C. per second to about 1.1° C. per second to achieve a peak metal temperature of the substrate ranging from about 120° C. to about 165° C., such that a dried basecoat is formed upon the surface of the metal substrate, similar to step 120 below. The velocity of the air at the surface of the basecoating composition is preferably less than about 4 meters per second during this drying step.

The dried basecoat that is formed upon the surface of the automobile body 16 is dried sufficiently to enable application of a topcoat such that the quality of the topcoat will not be affected adversely by further drying of the basecoat. For waterborne basecoats, "dry" means the almost complete absence of water from the basecoat. If too much water is present, the topcoat can crack, bubble or "pop" during drying of the topcoat as water vapor from the basecoat attempts to pass through the topcoat.

Preferably, the dried basecoat is cured prior to application of the topcoat if a powder topcoat is to be applied thereon. To cure the dried basecoat, the process of the present invention can further comprise an additional curing step in which hot air is applied to the dried basecoat for a period of at least about 6 minutes to achieve and hold a target peak metal temperature ranging from about 110° C. to about 135° C. Preferably, a combination of hot air convection drying and infrared radiation is used simultaneously to cure the dried basecoat. As used herein, "cure" means that any crosslinkable components of the dried basecoat are substantially crosslinked. This curing step can be carried out using a hot air convection dryer, such as are discussed above or in a similar manner to that of step 124 below using a combination infrared radiation/convection drying apparatus.

The basecoat can be cooled, if desired. Cooling the basecoated automobile body 16 can facilitate application of the topcoat by improving flow and reducing hot air eddy currents to increase transfer efficiency. The basecoated automobile body 16 can be cooled in air at a temperature ranging from about 15° C. to about 35° C., and preferably about 25° C. to about 30° C. for a period ranging from about 3 to about 6 minutes. Alternatively or additionally, the basecoated automobile body 16 can be cooled as discussed above for cooling the primer.

After the basecoating on the automobile body 16 has been dried (and cured and/or cooled, if desired), a topcoating composition is applied over the basecoat in step 116 or 210. The topcoat can be liquid, powder slurry (powder suspended in a liquid) or powder (solid), as desired. Preferably, the topcoating composition is a crosslinkable coating comprising one or more thermosettable film-forming materials and one or more crosslinking materials such as are discussed above. Useful film-forming materials include epoxy-functional film-forming materials, acrylics, polyesters and/or polyurethanes, as well as thermoplastic film-forming materials such as polyolefins can be used. The topcoating composition can include additives such as are discussed above for the basecoat, but preferably not pigments. If the topcoating is a liquid or powder slurry, volatile material(s) are included.

Suitable waterborne topcoats are disclosed in U.S. Pat. No. 5,098,947 (incorporated by reference herein) and are based on water soluble acrylic resins. Useful solvent borne topcoats are disclosed in U.S. Pat. Nos. 5,196,485 and 5,814,410 (incorporated by reference herein) and include epoxy-functional materials and polyacid curing agents. Suitable powder topcoats are described in U.S. Pat. No. 5,663,240 (incorporated by reference herein) and include epoxy functional acrylic copolymers and polycarboxylic acid crosslinking agents, such as dodecanedioic acid. The amount of the topcoating composition applied to the substrate can vary based upon such factors as the type of substrate and intended use of the substrate, i.e., the environment in which the substrate is to be placed and the nature of the contacting materials.

Referring now to FIG. 1, if the topcoating composition applied to the surface of the substrate is in liquid form, the process of the present invention comprises a next step 118 of exposing the liquid topcoating composition to low velocity air having a temperature ranging from about 10° C. to about 40° C., and preferably about 20° C. to about 30° C., for a period of at least about 30 seconds (preferably about 30 seconds to about 3 minutes) to volatilize at least a portion of the volatile material from the liquid topcoating composition and set the topcoating. This step is not necessary for treating powder or powder slurry topcoatings.

As used herein, the term "set" means that the liquid topcoating is tack-free (resists adherence of dust and other airborne contaminants) and is not disturbed or marred (waved or rippled) by air currents which blow past the topcoated surface. The velocity of the air at the exposed surface of the liquid topcoating is less than about 0.5 meters per second and preferably ranges from about 0.3 to about 0.5 meters per second.

Figure 2:
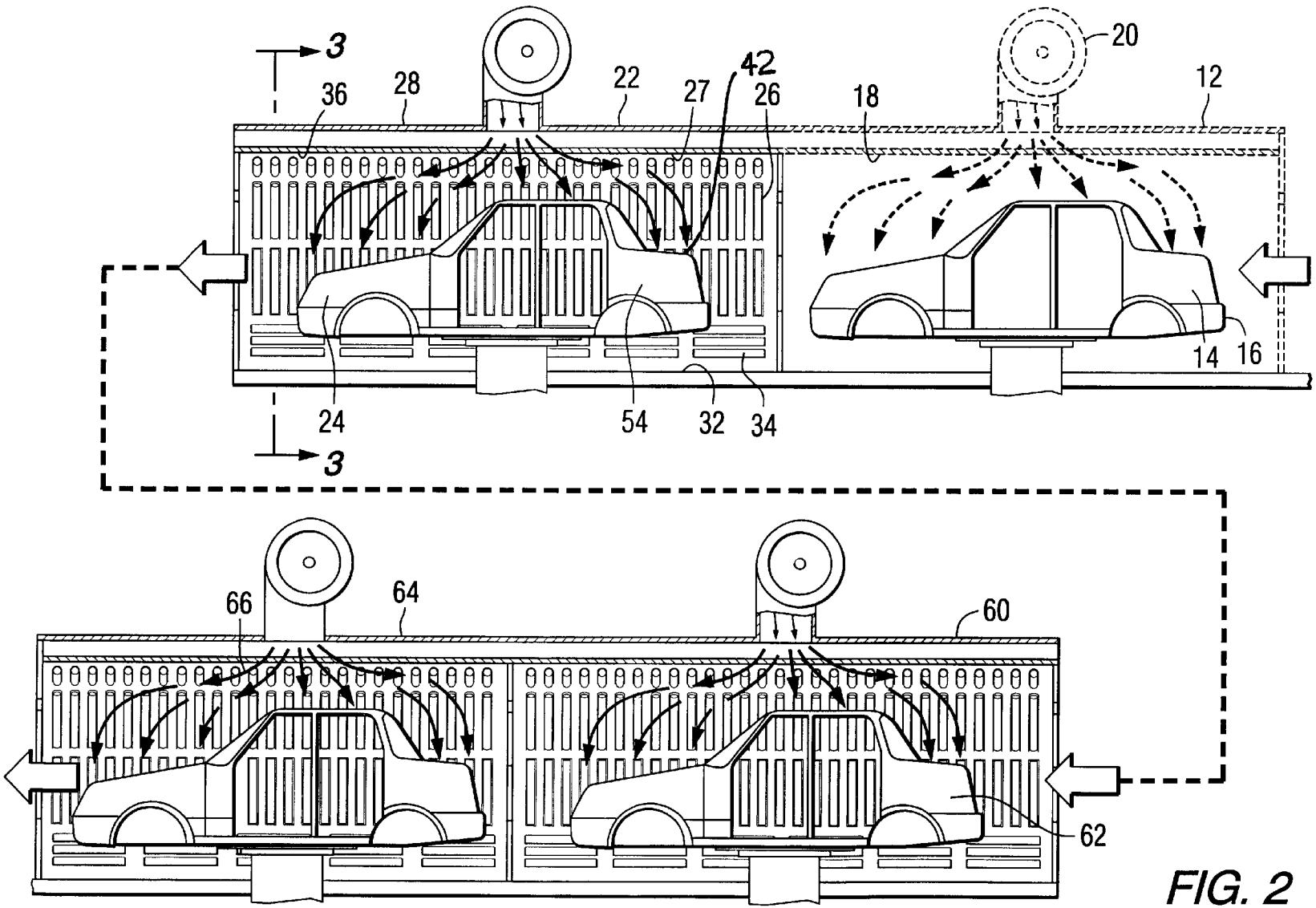
FIG. 2 is a side elevational schematic diagram of a portion of the process of FIG. 1.

The volatilization of the topcoating 14 from the surface of the automobile body 16 can be carried out in the open air, but is preferably carried out in a first drying chamber 18 in which air is circulated at low velocity to minimize airborne particle contamination as shown in FIG. 2. The automobile body 16 is positioned at the entrance to the first drying chamber 18 and slowly moved therethrough in assembly-line manner at a rate which permits the volatilization of the topcoating as discussed above. The rate at which the automobile body 16 is moved through the first drying chamber 18 and the other drying chambers discussed below depends in part upon the length and configuration of the drying chamber 18, but preferably ranges from about 3 meters per minute to about 7.3 meters per minute for a continuous process. One skilled in the art would understand that individual dryers can be used for each step of the process or that a single dryer having a plurality of individual drying chambers or sections (shown in FIG. 2) configured to correspond to each step of the process can be used, as desired.

The air preferably is supplied to the first drying chamber 18 by a blower 20 or dryer, shown in phantom in FIG. 2. A non-limiting example of a suitable blower is an ALTIVAR 66 blower that is commercially available from Square D Corporation. The air can be circulated at ambient temperature or heated, if necessary, to the desired temperature range of about 20° C. to about 40° C. Preferably, the topcoating is exposed to air for a period ranging from about 30 seconds to about 3 minutes before the automobile body 16 is moved to the next stage of the drying process.

Referring now to FIGS. 1 and 2, for drying a liquid topcoating, the process comprises a next step 120 of applying infrared radiation and low velocity warm air simultaneously to the topcoating for a period of at least about 1 minute (preferably about 1 to about 3 minutes) such that the temperature of the metal substrate is increased at a rate ranging from about 0.10° C. per second to about 0.25° C. per second (preferably about 0.15° C. to about 0.25° C. per second) to achieve a peak metal temperature ranging from about 25° C. to about 50° C., and preferably about 35° C. to about 50° C., and form a pre-dried topcoating upon the surface of the metal substrate. It is preferred that this peak metal temperature be maintained for as short a time as possible to minimize the possibility of crosslinking of the topcoating.

Referring now to FIG. 1A, for treating a powder slurry or powder topcoating, infrared radiation and low velocity warm air are applied to the coated metal substrate simultaneously for a period of at least about 2.5 minutes in step 212 such that the temperature of the metal substrate is increased at a rate ranging from about 0.5° C. per second to about 0.8° C. per second to achieve a peak metal temperature ranging from about 90° C. to about 125° C. and form a melted and/or sintered topcoating upon the surface of the metal substrate.

By controlling the rate at which the metal temperature is increased and peak metal temperature, flaws in the appearance of the topcoat, such as pops and bubbles, can be minimized.

The infrared radiation applied preferably includes near-infrared region (0.7 to 1.5 micrometers) and intermediate-infrared region (1.5 to 20 micrometers) radiation, and more preferably ranges from about 0.7 to about 4 micrometers. The infrared radiation heats the Class A (external) surfaces 24 of the coated substrate which are exposed to the radiation and preferably does not induce chemical reaction or crosslinking of the components of the electrodeposited coating. Most non-Class A surfaces are not exposed directly to the infrared radiation but will be heated through conduction through the automobile body and random scattering of the infrared radiation.

Figure 3:
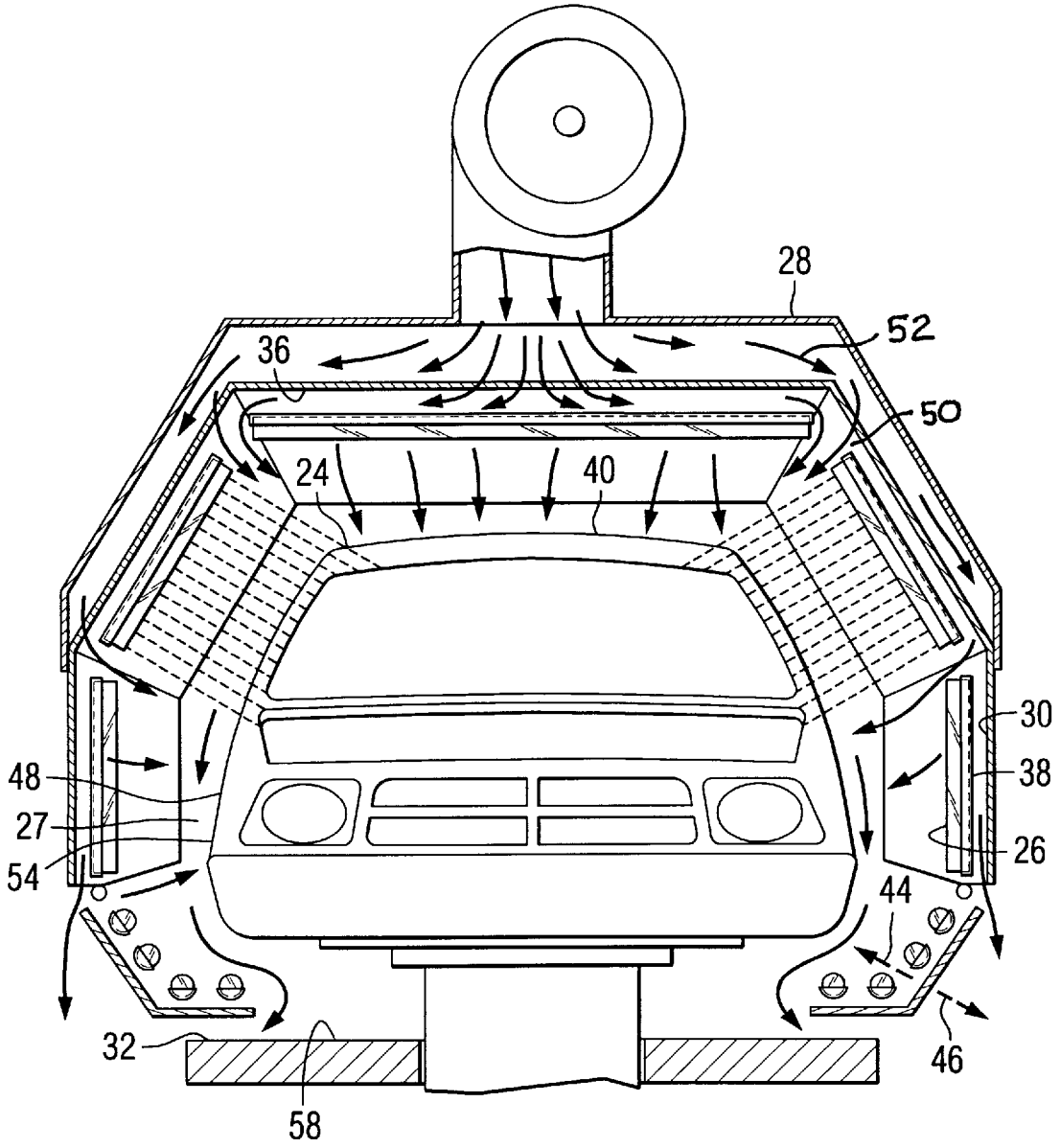
FIG. 3 is a front elevational view taken along line 3—3 of a portion of the schematic diagram of FIG. 2.

Referring now to FIGS. 2 and 3, the infrared radiation is emitted by a plurality of emitters 26 arranged in the interior drying chamber 27 of a combination infrared/convection drying apparatus 28. Each emitter 26 is preferably a high intensity infrared lamp, preferably a quartz envelope lamp having a tungsten filament. Useful short wavelength (0.76 to 2 micrometers), high intensity lamps include Model No. T-3 lamps such as are commercially available from General Electric Co., Sylvania, Phillips, Heraeus and Ushio and have an emission rate of between 75 and 100 watts per lineal inch at the light source. Medium wavelength (2 to 4 micrometers) lamps also can be used and are available from the same suppliers. The emitter lamp is preferably generally rod-shaped and has a length that can be varied to suit the configuration of the oven, but generally is preferably about 0.75 to about 1.5 meters long. Preferably, the emitter lamps on the side walls 30 of the interior drying chamber 27 are arranged generally vertically with reference to ground 32, except for a few rows 34 (preferably about 3 to about 5 rows) of emitters 26 at the bottom of the interior drying chamber 27 which are arranged generally horizontally to ground 32.

The number of emitters 26 can vary depending upon the desired intensity of energy to be emitted. In a preferred embodiment, the number of emitters 26 mounted to the ceiling 36 of the interior drying chamber 27 is about 24 to about 32 arranged in a linear side-by side array with the emitters 26 spaced about 10 to about 20 centimeters apart from center to center, and preferably about 15 centimeters. The width of the interior drying chamber 27 is sufficient to accommodate the automobile body or whatever substrate component is to be dried therein, and preferably is about 2.5 to about 3.0 meters wide. Preferably, each side wall 30 of the chamber 27 has about 50 to about 60 lamps with the lamps spaced about 15 to about 20 centimeters apart from center to center. The length of each side wall 30 is sufficient to encompass the length of the automobile body or whatever substrate component is being dried therein, and preferably is about 4 to about 6 meters. The side wall 30 preferably has four horizontal sections that are angled to conform to the shape of the sides of the automobile body. The top section of the side wall 30 preferably has 24 parallel lamps divided into 6 zones. The three zones nearest the entrance to the drying chamber 27 are operated at medium wavelengths, the three nearest the exit at short wavelengths. The middle section of the side wall is configured similarly to the top section. The two lower sections of the side walls each preferably contain 6 bulbs in a 2 by 3 array. The first section of bulbs nearest the entrance is preferably operated at medium wavelength and the other two sections at short wavelengths.

Referring to FIG. 2, each of the emitter lamps 26 is disposed within a trough-shaped reflector 38 that is preferably formed from polished aluminum. Suitable reflectors include aluminum or integral gold-sheathed reflectors that are commercially available from BGK-ITW Automotive, Heraeus and Fannon Products. The reflectors 38 gather energy transmitted from the emitter lamps 26 and focus the energy on the automobile body 16 to lessen energy scattering.

Depending upon such factors as the configuration and positioning of the automobile body 16 within the interior drying chamber 27 and the color of the topcoat to be dried, the emitter lamps 26 can be independently controlled by microprocessor (not shown) such that the emitter lamps 26 furthest from a Class A surface 24 can be illuminated at a greater intensity than lamps closest to a Class A surface 24 to provide uniform heating. For example, as the roof 40 of the automobile body 16 passes beneath a section of emitter lamps 26, the emitter lamps 26 in that zone can be adjusted to a lower intensity until the roof 40 has passed, then the intensity can be increased to heat the deck lid 42 which is at a greater distance from the emitter lamps 26 than the roof 40.

Also, in order to minimize the distance from the emitter lamps 26 to the Class A surfaces 24, the position of the side walls 30 and emitter lamps 26 can be adjusted toward or away from the automobile body as indicated by directional arrows 44, 46, respectively, in FIG. 3. One skilled in the art would understand that the closer the emitter lamps 26 are to the Class A surfaces 24 of the automobile body 16, the greater the percentage of available energy which is applied to heat the surfaces 24 and coatings present thereon. Generally, the infrared radiation is emitted at a power density ranging from about 10 to about 25 kilowatts per square meter ($kW/m^2$) of emitter wall surface, and preferably about 12 $kW/m^2$ for emitter lamps 26 facing the sides 48 of the automobile body 16 (doors or fenders) which are closer than the emitter lamps 26 facing the hood and deck lid 42 of the automobile body 16, which preferably emit about 24 $kW/m^2$.

A non-limiting example of a suitable combination infrared/convection drying apparatus is a BGK combined infrared radiation and heated air convection oven, which is commercially available from BGK Automotive Group of Minneapolis, Minn. The general configuration of this oven will be described below and is disclosed in U.S. Pat. Nos. 4,771,728; 4,907,533; 4,908,231; and 4,943,447, which are hereby incorporated by reference. Other useful combination infrared/convection drying apparatus are commercially available from Durr of Wixom, Mich., Thermal Innovations of Manasquan, N.J., Thermovation Engineering of Cleveland, Ohio, Dry-Quick of Greenburg, Ind. and Wisconsin Oven and Infrared Systems of East Troy, Wis.

Referring now to FIGS. 2 and 3, the preferred combination infrared/convection drying apparatus 28 includes baffled side walls 30 having nozzles or slot openings 50 through which air 52 is passed to enter the interior drying chamber 27 at a velocity of less than about 4 meters per second. During this step, the velocity of the air at the surface 54 of the topcoating is less than about 4 meters per second, preferably ranges from about 0.5 to about 4 meters per second and, more preferably, about 0.7 to about 1.5 meters per second.

The temperature of the air 52 generally ranges from about 50° C. to about 110° C., and preferably about 60° C. to about 95° C., for drying the liquid topcoat. For drying/coalescing a powder slurry or powder topcoat, the temperature of the air 52 generally ranges from about 80° C. to about 110° C. The air 52 is supplied by a blower 56 or dryer and can be preheated externally or by passing the air over the heated infrared emitter lamps 26 and their reflectors 38. By passing the air 52 over the emitters 26 and reflectors 38, the working temperature of these parts can be decreased, thereby extending their useful life. Also, undesirable solvent vapors can be removed from the interior drying chamber 27. The air 52 can also be circulated up through the interior drying chamber 27 via the subfloor 58. Preferably, the air flow is recirculated to increase efficiency. A portion of the air flow can be bled off to remove contaminants and supplemented with filtered fresh air to make up for any losses.

Referring now to FIGS. 1 and 2, for drying a liquid topcoating composition, the process of the present invention comprises a next step 122 of applying infrared radiation and hot air simultaneously to the topcoating on the metal substrate (automobile body 16) for a period of at least about 30 seconds, and preferably between 30 seconds and 3 minutes. The temperature of the metal substrate is increased at a rate ranging from about 0.5° C. per second to about 1.6° C. per second (preferably about 0.6° C. to about 1.0° C. per second) to achieve a peak metal temperature of the substrate ranging from about 65° C. to about 140° C. (preferably about 80° C. to about 120° C.). A dried topcoat 62 is formed thereby upon the surface of the metal substrate.

Referring now to FIG. 1A, for treating a powder or powder slurry topcoating, infrared radiation and hot air are applied to the coated metal substrate simultaneously for a period of at least about 2 minutes in step 214 such that the temperature of the metal substrate is increased at a rate ranging from about 0.1° C. per second to about 1.5° C. per second to achieve a peak metal temperature ranging from about 125° C. to about 200° C. to form a cured topcoating upon the surface of the metal substrate.

This step 122, 214 can be carried out in a similar manner to that of step 120 above using a combination infrared radiation/convection drying apparatus, however the rate at which the temperature of the metal substrate is increased and peak metal temperature of the substrate vary as specified.

The infrared radiation applied preferably includes near-infrared region (0.7 to 1.5 micrometers) and intermediate-infrared region (1.5 to 20 micrometers) radiation, and more preferably ranges from about 0.7 to about 4 micrometers.

The hot drying air preferably has a temperature ranging from about 100° C. to about 140° C. for liquid topcoat and about 120° C. to about 160° C. for powder or powder slurry topcoat. The velocity of the air at the surface of the primer coating in step 122, 214 is preferably less than about 6 meters per second, and preferably ranges from about 1 to about 4 meters per second.

Step 122, 214 can be carried out using any conventional combination infrared/convection drying apparatus such as the BGK combined infrared radiation and heated air convection oven which is described in detail above. The individual emitters 26 can be configured as discussed above and controlled individually or in groups by a microprocessor (not shown) to provide the desired heating and infrared energy transmission rates.

Preferably, the liquid topcoating also is cured. To cure the liquid topcoating, the process of the present invention can further comprise an additional curing step 124 in which hot air 66 is applied to the topcoating (and any uncured basecoat, if present) for a period of at least about 10 minutes after step 122 to achieve and hold a peak metal temperature ranging from about 120° C. to about 170° C. and cure the topcoating. Preferably, a combination of hot air convection drying and infrared radiation is used simultaneously to cure the basecoat and topcoating. As used herein, "cure" means that any crosslinkable components of the basecoat and topcoating are substantially crosslinked.

This curing step 124 can be carried out using a hot air convection dryer, such as are discussed above, or in a similar manner to that of step 120 above using a combination infrared radiation/convection drying apparatus. The hot drying air preferably has a temperature ranging from about 140° C. to about 210° C., and more preferably about 160° C. to about 200° C. The velocity of the air at the surface of the topcoating in curing step 124 can range from about 4 to about 20 meters per second, and preferably ranges from about 10 to about 20 meters per second.

If a combination of hot air and infrared radiation is used, the infrared radiation applied preferably includes near-infrared region (0.7 to 1.5 micrometers) and intermediate-infrared region (1.5 to 20 micrometers), and more preferably ranges from about 0.7 to about 4 micrometers. Curing step 124 can be carried out using any conventional combination infrared/convection drying apparatus such as the BGK combined infrared radiation and heated air convection oven which is described in detail above. The individual emitters 26 can be configured as discussed above and controlled individually or in groups by a microprocessor (not shown) to provide the desired heating and infrared energy transmission rates.

Another aspect of the present invention is a process for drying a multicomponent composite coating composition applied to a surface of a metal substrate. The multicomponent coating is a composite of the basecoat and the topcoat applied thereover. The multicomponent composite coating is exposed to air having a temperature ranging from about 10° C. to about 40° C. for a period of at least about 30 seconds to volatilize at least a portion of volatile material from the multicomponent composite coating in a manner similar to step 116 above. The velocity of the air at a surface of the multicomponent composite coating composition is less than about 0.5 meters per second. Infrared radiation and warm air are applied simultaneously to the multicomponent composite coating for a period of at least about 1 minute. The velocity of the air at the surface of the multicomponent composite coating is less than about 4 meters per second. The temperature of the metal substrate is increased at a rate ranging from about 0.1° C. per second to about 0.25° C. per second to achieve a peak metal temperature of the substrate ranging from about 25° C. to about 50° C. in a manner similar to step 120 above.

Next, infrared radiation and hot air are applied simultaneously to the multicomponent composite coating for a period of at least about 30 seconds, preferably between about 30 seconds and 3 minutes. The temperature of the metal substrate is increased at a rate ranging from about 0.5° C. per second to about 1.6° C. per second to achieve a peak metal temperature of the substrate ranging from about 65° C. to about 140° C., such that a dried multicomponent composite coating is formed upon the surface of the metal substrate. To cure the composite coating, infrared radiation and/or hot air can be applied to achieve a peak metal temperature of about 120° C. to about 170° C., and preferably about 140° C. to about 154° C., and held at that temperature for at least about 10 minutes (preferably about 10 to about 20 minutes) to cure the composite coating.

Another aspect of the present invention is a process for drying a liquid or powder slurry topcoating composition applied to a surface of a polymeric substrate. The process includes steps similar to those used for drying a liquid topcoating applied to a metal substrate above. A liquid topcoating composition is applied to a surface of the polymeric substrate as described above. The topcoating composition is exposed to air having a temperature ranging from about 10° C. to about 40° C. for a period of at least about 30 seconds to volatilize at least a portion of volatile material from the liquid basecoating composition. The velocity of the air at a surface of the topcoating composition is less than about 4 meters per second, and preferably ranges from about 0.3 to about 0.5 meters per second. The apparatus used to volatilize the topcoat can be the same as that used to volatilize the topcoat for the metal substrate.

Infrared radiation and warm air are applied simultaneously to the basecoating composition for a period of at least about 1 minute and preferably about 1 to about 3 minutes. The velocity of the air at the surface of the basecoating composition is less than about 4 meters per second, and preferably ranges from about 0.7 to about 1.5 meters per second. The temperature of the polymeric substrate is increased at a rate ranging from about 0.10° C. per second to about 0.25° C. per second to achieve a peak polymeric substrate temperature ranging from about 25° C. to about 50° C. The apparatus used to dry the topcoat can be the same combined infrared/hot air convection apparatus such as is discussed above for treating the metal substrate.

Next, infrared radiation and hot air are applied simultaneously to the topcoating composition for a period of at least about 30 seconds and preferably about 0.5 to about 3 minutes. The velocity of the air at the surface of the basecoating composition is preferably less than about 4 meters per second, and preferably ranges from about 1.5 to about 2.5 meters per second. The temperature of the polymeric substrate is increased at a rate ranging from about 0.5° C. per second to about 1.0° C. per second to achieve a peak polymeric substrate temperature which is less than the heat distortion temperature of the polymeric substrate and ranges from about 130° C. to about 150° C., such that a dried topcoat is formed upon the surface of the polymeric substrate. The heat distortion temperature is the temperature at which the polymeric substrate physically deforms and is incapable of resuming its prior shape. For example, the heat distortion temperatures for several common thermoplastic materials are as follows: thermoplastic olefins about 138° C. (280° F.), thermoplastic polyurethanes about 149° C. (300° F.), and acrylonitrile-butadiene-styrene copolymers about 71–82° C. (160–180° F.).

The topcoat can be cured by holding the peak metal temperature at a target of about 130° C. to about 150° C. for about 10 to about 20 minutes to cure the topcoat. The apparatus used to dry and/or cure the topcoat can be the same combined infrared/hot air convection apparatus such as is discussed above for treating the metal substrate.

For coalescing a powder topcoating composition, infrared radiation and warm air can be applied simultaneously for a period of at least about 2.5 minutes at an air velocity of less than about 4 meters per second. The temperature of the polymeric substrate is increased at a rate ranging from about 0.5° C. per second to about 0.8° C. per second to achieve a peak polymeric substrate temperature ranging from about 90° C. to about 125° C. Next, infrared radiation and hot air is applied simultaneously to the powder topcoat composition for a period of at least about 2 minutes to increase the peak substrate temperature at a rate of about 0.1° C. per second to about 1.5° C. per second to achieve a peak substrate temperature ranging from about 125° C. to about 200° C. such that a coalesced topcoat is formed upon the surface of the polymeric substrate.

The present invention will be described further by reference to the following example. The following example is merely illustrative of the invention and is not intended to be limiting. Unless otherwise indicated, all parts are by weight.

EXAMPLE

In this example, steel test panels were coated with a liquid basecoat and liquid clearcoat as specified below to evaluate drying processes according to the present invention. The test substrates were cold rolled steel panels, commercially available from ACT laboratories, Hillsdale, Mich. size 30.48 cm by 45.72 cm (12 inch by 18 inch) electrocoated with a cationically electrodepositable primer commercially available from PPG Industries, Inc. as ED-5000. Commercial waterborne basecoat (HDWB5033 silver basecoat which is commercially available from PPG Industries, Inc.) was spray applied using an automated spray (bell) applicator at 35000 rpm, 60,000 VOLTS, 3.0 bar air, 4.6 meters/minute line speed, 25" #4 Ford Cup viscosity in one coat with 30 seconds ambient flash at 60% relative humidity and 24° C. to give a dry film thickness as specified in Tables 1A and 1C below. The basecoat coatings on the panels were dried using a combined infrared radiation and heated air convection oven commercially available from BGK-ITW Automotive Group of Minneapolis, Minn. First the coated panels were exposed to ambient (about 25° C.) air for about 30 seconds.

Next the panels were exposed for 30 seconds to a combination of infrared radiation and warm air convection drying. The infrared watt density was about 7 to about 9 kW/sq. m. The air temperature was about 49° C. and air flow rate was about 0.64 m/s. The peak metal heating rate was about 0.07° C. per second (horizontal) and about 0.11° C. per second (vertical). The peak metal temperature attained was about 23–24° C. Next, the coated panels were exposed for 30 seconds to a combination of infrared radiation and hot air convection drying. The infrared waft density was about 16.5 to about 21 kW/sq. m. The air temperature was about 77° C. and air flow rate was about 1.5–2.5 m/s. The peak metal heating rate was about 0.56° C. per second (horizontal) and about 1.11° C. per second (vertical). The peak metal temperature attained was about 44° C. (horizontal) and about 54° C. (vertical).

The panels were then topcoated with liquid DIAMONDCOAT® DCT-5002 topcoat (commercially available from PPG Industries, Inc.) using bell applicators at 30,000 rpm, 80,000 volts, 25" #4 Ford Cup viscosity in one coat and cured as discussed in Tables 1A, 1B and 2 below. The control panel and Run No. 1 each received 2 coats of topcoat with a 1 minute flash between coats. The panel for Run No. 2 received 3 coats of topcoat with a 1 minute flash between each coat.

TABLE 1A

| RUN | CONTROL | 1 | 2 |
|---|---|---|---|
| Dry Film Thickness BC/CC (mil) | 0.6–0.8<br>1.7–22 | 0.6–0.8<br>1.7–2.2 | 0.6–0.8<br>2.4–3.7 |
| FLASH STEP | | | |
| Time (sec) | 600 | 30 | 30 |
| SET STEP | | | |
| Time (sec) | NONE | 60 | 60 |
| IR Watt Density (kW/sq. m) | — | 2–3 | 2–3 |
| Air Temp. | 23° C. (73° F.) | 35° C. (95° F.) | 50° C. (122° F.) |
| Air Flow Rate (m/sec) | 0.50 | 0.64 | 0.64 |
| Peak Metal Temp. | — 23° C. (73° F.) | 36° C. (96° F.) | — 41° C. (105° F.) |
| Peak Metal Heating Rate degrees per second | — N/A | 0.13° C./s | — 0.15° C./s |

TABLE 1B

| RUN | CONTROL | 1 | 2 |
|---|---|---|---|
| DRYING STEP | | | |
| Time (sec) | NONE | 30 | 30 |
| IR Watt Density (kW/sq. m) | NONE | 16.5 | 16.5 |
| Average Air Temp. | 23° C. | 77° C. (170° F.) | 77° C. (170° F.) |
| Air Flow Rate (m/sec) | 1.5–2.5 | 1.5–2.5 | 1.5–2.5 |
| Peak Metal Temp. | — — | 83° C. (181° F.) | — 83° C. (181° F.) |
| Peak Metal Heating Rate degrees per second | — — | 1.6° C. | — 1.4° C. |
| Dry Film Thickness CC (mil) | — 1.7–2.2 | 1.7–2.2 | — 2.4–3.7 |

The appearance and physical properties of the coated panels were measured using the following appearance tests: number of pops, orange peel rating and overall rating. The number of pops on the surface of the coating of each sample was determined by visual inspection of the entire panel surface. Popping was rated on a scale of 0 to 5, with 0 indicating no popping and 5 indicating severe popping. The orange peel rating, specular gloss and Distinction of Image ("DOI") were determined by scanning a 9375 square mm sample of panel surface using an Autospect QMS BP surface quality analyzer device that is commercially available from Perceptron. The Overall Appearance rating was determined by adding 40% of the Orange Peel rating, 20% of the Gloss rating and 40% of the DOI rating. The following Table 2 provides the measured properties.

As shown in Table 2, the coated substrate of Run No. 2 dried according to the process of the present invention, which had a much thicker layer of clearcoat than the Control panel, exhibited similar low pop and good DOI, orange peel and overall appearance compared to the Control panel in which the topcoating was not dried according to the present invention.

TABLE 2

| | | | | Appearance | | |
|---|---|---|---|---|---|---|
| Run No. | Horizontal or vertical | Dry Film thickness CC (mil) | POPS | DOI | Orange Peel Rating | Overall Rating |
| CONTROL | H | 1.7–2.2 | none | 60 | 61.3 | 59.5 |
| 1 | H | 1.7–2.2 | none | 49 | 53 | 49 |
| 2 | H | 2.4–3.7 | none | 61 | 56 | 61 |

The processes of the present invention provide rapid coating of metal and polymeric substrates, can eliminate or reduce the need for long assembly line ovens can drastically reduce overall processing time. Less popping and good flow and appearance of the basecoat, even at higher thicknesses, provides more operating latitude when applying the basecoat which can lower repairs.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

Therefore, I claim:

1. A process for drying a liquid topcoating composition applied to a surface of a metal substrate, comprising the steps of:

(a) applying air having a first air temperature ranging from about 10° C. to about 40° C. to the liquid topcoating composition for a first period of at least 30 seconds to volatilize at least a portion of volatile material from the liquid topcoating composition, a first velocity of the air at a surface of the topcoating composition ranging from about 0.3 to about 0.5 meters per second;

(b) applying a first infrared radiation at a power density of about 25 kilowatts per meter square or less and warm air having a second air temperature ranging from about 50° C. to about 110° C. simultaneously to the topcoating composition for a second period of at least about 1 minute, a second velocity of the air at the surface of the topcoating composition ranging from about 0.5 to about 4 meters per second, a first temperature of the metal substrate being increased at a first rate ranging from about 0.10° C. per second to about 0.25° C. per second to achieve a first peak metal temperature of the substrate ranging from about 25° C. to about 50° C; and (c) applying a second infrared radiation and hot air having a third air temperature ranging from about 100° C. to about 140° C. simultaneously to the topcoating composition for a third period of at least 30 seconds, a second temperature of the metal substrate being increased at a second rate ranging from about 0.5° C. per second to about 1.6° C. per second to achieve a second peak metal temperature of the substrate ranging from about 65° C. to about 140° C., such that a dried topcoat is formed upon the surface of the metal substrate.

2. The process according to claim 1, wherein the metal substrate is selected from the group consisting of iron, steel, aluminum, zinc, magnesium, alloys and combinations thereof.

3. The process according to claim 1, wherein the metal substrate is an automotive body component.

4. The process according to claim 1, wherein the volatile material of the liquid topcoating composition comprises water.

5. The process according to claim 1, wherein the volatile material of the liquid topcoating composition comprises an organic solvent.

6. The process according to claim 1, wherein the first period ranges from about 30 seconds to about 3 minutes in the step (a).

7. The process according to claim 1, wherein the first and second infrared radiation are emitted at a wavelength ranging from about 0.7 to about 20 micrometers.

8. The process according to claim 7, wherein the wavelength ranges from about 0.7 to about 4 micrometers.

9. The process accordingly to claim 1, wherein the first and second infrared radiations are emitted at a power density ranging from about 10 to about 40 kilowatts per square meter.

10. The process according to claim 1, wherein the second period ranges from about 1 to about 3 minutes in the step (b).

11. The process according to claim 1, wherein the second velocity ranges from about 0.5 to about 4 meters per second in the step (b).

12. The process according to claim 1, wherein the prior temperature of the metal substrate is increased at the rate ranging from about 0.15° C. per second to about 0.2° C. per second in the step (b).

13. The process according to claim 1, wherein the first peak metal temperature of the metal substrate ranges from about 35° C. to about 50° C. in the step (b).

14. The process according to claim 1, wherein the third period ranges from about 30 seconds to about 3 minutes in the step (c).

15. The process according to claim 1, wherein the prior temperature of the metal substrate is increased at the rate ranging from about 0.6° C. per second to about 1.0° C. per second in the step (c).

16. The process according to claim 1, wherein the second peak metal temperature of the metal substrate ranges from about 80° C. to about 120° C. in the step (c).

17. The process according to claim 1, further comprising an additional step (d) of applying hot air having a fourth air temperature ranging from about 140° C. to about 210° C. to the dried topcoat after the step (c) to achieve a third peak metal temperature ranging from about 120° C. to about 170° C. for a fourth period of at least 10 minutes, such that a cured topcoat is formed upon the surface of the metal substrate.

18. The process according to claim 17, wherein the additional step (d) further comprises applying a third infrared radiation to the dried topcoat simultaneously while applying the hot air.

19. The process according to claim 1, further comprising a step of applying the liquid topcoating composition to the surface of the metal substrate prior to the step (a).

20. The process according to claim 19, further comprising a step of applying a basecoating composition to the surface of the metal substrate prior to applying the liquid topcoating composition.

21. The process according to claim 20, further comprising a step of applying a liquid primer coating composition to the surface of the metal substrate prior to applying the liquid basecoating composition.

22. The process according to claim 22, wherein the metal substrate has a coating electrodeposited thereon prior to applying the primer coating.

23. The process according to claim 20, wherein the metal substrate has a coating electrodeposited thereon prior to applying the basecoating composition.

24. A process for drying a multicomponent composite coating composition applied to a surface of a metal substrate, comprising the steps of:

(a) applying a liquid basecoating composition to the surface of the metal substrate;

(b) applying a liquid topcoating composition over the basecoating composition to form a multicomponent composite coating upon the metal substrate;

(c) applying air having a first air temperature ranging from about 10° C. to about 40° C. to the multicomponent composite coating for a first period of at least 30 seconds to volatilize at least a portion of volatile material from the multicomponent composite coating, a first velocity of the air at a surface of the multicomponent composite coating composition ranging from about 0.3 to about 0.5 meters per second;

(d) applying a first infrared radiation at a power density of about 25 kilowatts per meter square or less and warm air having a second air temperature ranging from about 50° C. to about 110° C. simultaneously to the multicomponent composite coating for a second period of at least about 1 minute, a second velocity of the air at the surface of the multicomponent composite coating ranging from about 0.5 to about 4 meters per second, a first temperature of the metal substrate being increased at a first rate ranging from about 0.1° C. per second to about 0.25° C. per second to achieve a first peak metal temperature of the substrate ranging from about 25° C. to about 50° C.; and (e) applying a second infrared radiation and hot air having a third air temperature ranging from about 100° C. to about 140° C. simultaneously to the multicomponent composite coating for a third period of at least 30 seconds, a second temperature of the metal substrate being increased at a second rate ranging from about 0.5° C. per second to about 1.6° C. per second to achieve a second peak metal temperature of the substrate ranging from about 65° C. to about 140° C., such that a dried multicomponent composite coating is formed upon the surface of the metal substrate.

25. The process according to claim 24, further comprising the step of applying a liquid primer coating composition to the surface of the metal substrate prior to applying the liquid basecoating composition.

26. The process according to claim 24, further comprising an additional step (f) of applying a third infrared radiation and hot air having a fourth air temperature ranging from about 140° C. to about 210° C. simultaneously to the multicomponent composite coating to achieve a third peak metal temperature of the substrate ranging from about 120° C. to about 170° C. for a fourth period of at least 10 minutes, such that a cured multicomponent composite coating is formed upon the surface of the metal substrate.

27. A process for coalescing a powder topcoating composition applied to a surface of a metal substrate having an electrodeposited coating thereon, comprising the steps of:

(a) applying a first infrared radiation at a power density of about 25 kilowatts per meter square or less and warm air having a first air temperature ranging from about 80° C. to about 110° C. simultaneously to the powder topcoating composition for a first period of at least 2.5 minutes, a first velocity of the air at the surface of the powder topcoating composition ranging from about 0.5 to about 4 meters per second, a first temperature of the metal substrate being increased at a first rate ranging from about 0.5° C. per second to about 0.8° C. per second to achieve a first peak metal temperature of the substrate ranging from about 90° C. to about 125° C.; and (b) applying a second infrared radiation and hot air having a second air temperature ranging from about 120° C. to about 160° C. simultaneously to the powder topcoating composition for a second period of at least 2 minutes, a second temperature of the metal substrate being increased at a second rate ranging from about 0.1° C. per second to about 1.5° C. per second to achieve a second peak metal temperature of the substrate ranging from about 125° C. to about 200° C., such that a coalesced topcoat is formed upon the surface of the metal substrate having the electrodeposited coating thereon.

28. The process according to claim 27, further comprising an additional step (c) of applying a third infrared radiation and hot air having a third air temperature ranging from about 140° C. to about 210° C. simultaneously to the powder topcoating composition to achieve a third peak metal temperature of the substrate ranging from about 140° C. to about 170° C. for a third period of at least 15 minutes, such that a cured topcoat is formed upon the surface of the metal substrate.

29. A process for drying a multicomponent composite coating composition applied to a surface of a polymeric substrate, comprising the steps of:

(a) applying a liquid basecoating composition to the surface of the substrate;

(b) applying a liquid topcoating composition over the basecoating composition to form a multicomponent composite coating upon the substrate;

(c) applying air having a first air temperature ranging from about 10° C. to about 40° C. to the multicomponent composite coating for a first period of at least 30 seconds to volatilize at least a portion of volatile material from both the basecoating composition and topcoating composition, a first velocity of the air at a surface of the multicomponent composite coating composition ranging from about 0.3 to about 4 meters per second;

(d) applying a first infrared radiation at a power density of about 25 kilowatts per meter square or less and warm air having a second air temperature ranging from about 50° C. to about 110° C. simultaneously to the multicomponent composite composition for a second period of at least 1 minute, a second velocity of the air at the surface of the multicomponent composite composition ranging from about 0.5 to about 4 meters per second, a first temperature of the metal substrate being increased at a rate ranging from about 0.10° C. per second to about 0.25° C. per second to achieve a first peak metal temperature of the substrate ranging from about 25° C. to about 50° C.; and (e) applying a second infrared radiation and hot air having a third air temperature ranging from about 100° C. to about 140° C. simultaneously to the multicomponent composite composition for a third period of at least 30 seconds, a second temperature of the substrate being increased at a rate ranging from about 0.5° C. per second to about 1.0° C. per second to achieve a second peak substrate temperature ranging from about 130° C. to about 150° C. such that a dried multicomponent composite coating is formed upon the surface of the substrate.

30. The process according to claim 29, further comprising an additional step (f) of applying a third infrared radiation and hot air having a fourth air temperature ranging from about 140° C. to about 210° C. simultaneously to the coalesced multicomponent composite coating to achieve a third peak temperature of the substrate ranging from about 130° C. to about 150° C. for a fourth period of at least 10 minutes such that a cured multicomponent composite coating is formed upon the surface of the substrate.

* * * * *

UNITED STATES PATENT AND TRADEMARK OFFICE

CERTIFICATE OF CORRECTION

PATENT NO. : 6,231,932 B1
DATED : May 15, 2001
INVENTOR(S) : Emch

It is certified that error appears in the above-identified patent and that said Letters Patent is hereby corrected as shown below:

Column 21,
Line 44, delete the word “prior” and insert -- first --.
Line 54, delete the word “prior” and insert -- second --.

Signed and Sealed this

Thirtieth Day of July, 2002

*Attest:*

*Attesting Officer*

JAMES E. ROGAN
*Director of the United States Patent and Trademark Office*